United States Patent [19]

Tournier et al.

[11] 4,194,986

[45] Mar. 25, 1980

[54] POWDERED OR FLAKED WASHING COMPOSITIONS ADAPTED TO AUTOMATIC LAUNDRY MACHINES

[75] Inventors: Hervé Tournier, Valleiry; Alain Groult, Annemasse, both of France

[73] Assignee: Union Generale de Savonnerie, Marseille, France

[21] Appl. No.: 874,227

[22] Filed: Feb. 1, 1978

[30] Foreign Application Priority Data

Feb. 2, 1977 [CH] Switzerland ..... 1223/77

[51] Int. Cl.[2] ..... C11D 7/54; C11D 7/60

[52] U.S. Cl. ..... 252/102; 252/99; 252/117; 252/121; 252/544; 252/552; 252/559

[58] Field of Search ..... 252/102, 99, 117, 121, 252/544, 552, 559

[56] References Cited

U.S. PATENT DOCUMENTS 4,048,085 9/1977 Heslam ..... 252/102

*Primary Examiner*—Mayer Weinblatt

*Attorney, Agent, or Firm*—Finnegan, Henderson, Farabow, Garrett & Dunner

[57] ABSTRACT

A detergent composition mainly for automatic laundering machines which comprises, on the basis of 100 parts by weight of total composition, at least 60 parts of soap and no more than 10 parts of a mixture of surfactants comprising 10 to 30% of at least one non-ionic polyoxyalkylated surfactant and 90 to 70% of an anionic surfactant selected essentially from α-sulfonated fatty acids derivatives, the remainder of the composition comprising at least one ingredient selected from alkaline detergent additives, bleaching agents, optical brighteners, fragrances, antiredeposition agents and enzymes.

The non-ionic surfactants are preferably fatty acid amides derived from tallow, copra or palm-oil condensed with polyoxyethylene residues.

The anionic surfactants are preferably α-sulfonated fatty esters or amides derived from tallow, copra or palm-oil. The proper combination of said non-ionic and anionic surfactants with soaps impart to the laundering compositions an excellent detergent ability and foam control even in very soft waters and non-polluting properties.

12 Claims, No Drawings

POWDERED OR FLAKED WASHING COMPOSITIONS ADAPTED TO AUTOMATIC LAUNDRY MACHINES

The present invention concerns powdered or flaked detergent compositions containing at least 60% of soap. It more particularly concerns compositions suitable for use at all temperature in washing-machines, namely automatic washers operating with soft and hard waters and adapted to all kinds of textile fabrics.

Conventional soaps are intrinsically excellent washing agents for fabrics & clothes when used under proper conditions, namely with soft or low hardness waters. They have also other favorable properties such as a total and rapid biodegradability, no toxicity, good water solubility, etc. Despite these qualities, soap has the drawback of not giving foam in hard waters. In such case, the hard soaps which form by the reaction with $Ca^{++}$, $Mg^{++}$ and other heavy ions tend to precipitate in the form of curds called "lime soaps". It becomes then necessary to add an excess of soap to produce the foam and the hard soaps then form clotted flocculates which redeposit on the textile fibers and on the inside parts of the washing-machines which may get clogged. Textile fibers which have been washed under such conditions are dull with off-colors, they are rough to the touch, they may smell unpleasantly and their water absorption capacity is diminished which is a distinctive drawback in the case of underwear and towels.

Several possibilities have been proposed to remedy these drawbacks. For instance, it is possible to replace soap in washing compositions, in part or totally, by synthetic detergents which do not form insoluble products with hard ions. Synthetic detergents are also capable of dispersing the hard soaps once formed and of preventing its redeposition on the fibers and on the inside parts of the washers. However, for achieving such results, it is necessary to use high ratios of synthetic detergents which are now expensive since they are synthesized from natural oil derivatives. Further, they are not easily biodegradable and may contribute to pollution as is the case for the widely used branched dodecyl-benzene sulfonate. As a consequence, consumers now prefer biodegradable detergents of natural origin.

In addition, synthetic detergents are generally used in admixtures with mineral salts (builders) which have the property of buffering the wash and to sequester the hard ions. The most commonly used salt is sodium tripolyphosphate which is very efficient but which is a very strong pollutant of rivers and lakes.

Another possibility is to soften water before it is used and thus eliminate the problems inherent to the use of soap in hard waters. However, this possibility is not economical for the consumers since it requires the installation of a water-softener apparatus on the water supply. However, water can still be softened in the wash itself without any modification to the washers now on the market. This softening can be performed by means of additives to the washing composition, i.e. appropriate sequestering agents for Ca, Mg and hard metal ions or by means of hard-soaps dispersing agents. However, in such softened waters, the soaps used as the main detergent ingredients for the automatic washing of fabrics generally produce a very large volume of foam. Many searches have been done on this problem, for instance by a Research Group at the "Eastern Regional Laborarory" and a series of 17 papers have been published in the Journal of the American Oil Chemists Society during 1972 through 1976. It was concluded that this problem of foam will probably prevent the large scale machine use of such washing compositions containing soap and lime-soap dispersants.

Other researchers have proposed to use jointly with soaps a synergistic mixture comprising an amphoteric detergent and a linear polycarboxylic acid in salt form. However, such synergistic detergents are very expensive and the consequences of the use of such synthetic products, for instance phosphono-carboxylic acids, on pollution and on the health of the consumers (skin problems) is still poorly investigated.

The compositions of the present invention which contain at least 60 parts of soap for a 100 parts by weight of the composition do not have the above-discussed drawbacks. They have a good dispersing capacity for the hard soaps, a good detergent power, and an excellent control ability on the froth development in the automatic washers. They further satisfy the present anti-pollution criteria as they contain very little synthetic dispersants and they are cheap because the composition ratio of the expensive synthetic components to soap is low.

The present compositions comprise, on the basis of 100 parts by weight of total composition, at least 60 parts of soap and no more than 10 parts of a mixture of surfactants comprising 1 to 3 parts of at least one non-ionic polyoxyalkylated surfactant and 9 to 7 parts of an anionic surfactant selected essentially from $\alpha$-sulfonated fatty acid derivatives; the remainder of the composition may comprise at least one ingredient selected from alkaline detergent additives, bleaching agents, optical brighteners, fragrances, antiredeposition agents and enzymes.

There exists already soap based laundering compositions containing, as lime-soap dispersants, anionic and non-ionic surfactants. Thus, U.S. Pat. No. 3,794,589 (FISHMAN) discloses a detergent composition containing, besides about 75 to 95 part of soap, about 5 to 15 parts of mixtures susceptible to contain higher molecular weight alkohols (non-ionic surfactant) such as alkyl-polyether alkohols, sorbitol, glyceryl esters of higher acids and anionic surfactants including sodium-alkyl sulfates, linear alkyl-aryl sulfonates, alkyl sulfonates, alkyl-aryl-polyether sulfates and sulfonates. Such anionic surfactants are therefore clearly distinguishable from the $\alpha$-sulfonated fatty acid derivatives of the invention and, as such, they impart to the laundry compositions distinctly different properties as will be shown in the Examples hereinafter which illustrate the invention.

Further, in British Pat. No. 638,637 (PROCTER & GAMBLE), there are disclosed detergent compositions also comprising soap, nonionic tensids such as fatty acid amides and anionic synthetic detergents which include salts of higher molecular weight monofatty acid esters of lower molecular weight hydroxyalkyl sulfonic acids such as the sodium salt of the coconut oil fatty acid monoester of 1,2-dihydroxy-propane-3-sulfonic acid, and the oleic acid ester of the sodium salt of isethionic acid. Included also are the higher molecular weight fatty acid amides of lower molecular weight amino alkyl sulfonic acids (for example, potassium salt of oleic acid amide of N-methyl taurine), the water-soluble salts of the higher molecular weight alcohol esters of sulfocarboxylic acids (for example, sodium salt of the lauryl alcohol ester of sulfoacetic acid), lower molecular weight sulfocarboxylic acid amides of alkylolamine esters of higher molecular weight fatty acids (for example, sodium salt of the sulfoacetamide of amino ethyl laurate), higher alkylated benzene sulfonic acids (for example, potassium salt of the sulfonic acid derived from the condensation product of benzene and a chlorinated kerosene fraction containing predominantly 12 carbon atoms per molecule), and ethers of higher molecular weight alcohols and lower molecular weight hydroxy alkyl sulfonic acids (for example, monolauryl ether of 1,2-dihydroxy-propane-3-sodium sulfonate and monolauryl ether of the sodium salt of isethionic acid). Therefore, the above list does not disclose any α-sulfonated fatty acid derivative like the anionic surfactants of the invention.

Preferably, the mixture of surfactants used in the composition of the invention comprises, by weight of the total composition, 1.5–3% of the nonionic surfactants, preferably 2–3%, more preferably about 2% and 6–8% of the anionic surfactants, more preferably 7.5%.

All usual fatty acid soaps are suitable for the present compositions but one preferably uses the Na, K and $NR_4$ salts of said fatty acids (R being H or an alkyl group ($C_{10}$–$C_{20}$)). Mixtures of different soaps can be used. Particularly interesting soaps are those derived from natural fatty acids namely from coconut, tallow and palm-oils. For instance coconut-oil generally contains a mixture of the following fatty acids (saturated $C_8$–$C_{18}$ structures): $C_8$ 8%, $C_{10}$ 7%, $C_{12}$ 48%, $C_{14}$ 17%, $C_{16}$ 9%, $C_{18}$ 2% and unsaturated acids, e.g. oleic acid 1% and linoleic acid 2%. Tallow soaps contain other proportions of fatty acids of which one typical composition of the following acids is: stearic 21.6%, oleic 40.5%, palmitic 25.9%, myristic 2.9% and lauric 0.07%. Other mixtures can also be used such as those from other animal tallows or lards. Fatty acids from coconut contain few unsaturated structures and can be kept under storage without oxidative decomposition. Tallow fatty acids which contain much unsaturation must preferably be hydrogenated for better storage properties.

The nonionic surfactants usable in the present composition can be mainly the condensation products of alkylene oxides with various hydroxy-compounds such as aliphatic alcohols, alkyl-phenols and other compounds with a labile hydrogen atom. Therefore, the following categories of nonionic surfactants are suitable for the present compositions:

1. The products resulting from the condensation of alkylene oxides, e.g. ethylene oxide with branched or linear aliphatic alcohols having 8–20 C atoms. These products can be obtained easily and economically from many natural sources, e.g. tallow, coconut and palm-oils, etc. For instance, one can use a condensation product of ethylene oxide with an alcohol derived from coconut-oil, this product containing 4 to 50, preferably 25 to 50, polycondensed ethylene oxide units per molecule of alcohol. The latter is a mixture of the alcohols $C_{10}$ to $C_{16}$ obtained by distillation of a saponified fraction of coconut-oil. Other similar products result from the condensation of 4 to 50 ethylene oxide units with alcohols derived from the saponification of tallow-oils.

2. The products of condensation of alkylene oxides, e.g. ethylene oxide, with alkyl- or dialkyl-phenols with branched or linear alkyl chains containing 4 to 16 C atoms. Such products preferably contain 5 to 50 ethylene oxide units per molecule of phenol. One particularly preferred product is η-nonyl-phenol condensed with 5–25 ethylene oxide (O.E.) units. Other liked products are for instance dodecyl-phenol condensed with 12 oxide of ethylene molecules (12 O.E.) and diisooctyl-phenol condensed with 15 O.E.

3. The products of condensation of an alkylene oxide, e.g. ethylene oxide, with the hydrophobic mass resulting from the condensation of propylene glycol and propylene oxide.

4. The products of condensation of an alkylene-oxide, e.g. ethylene-oxide with a product resulting from the reaction of propylene oxide with a diamine such as ethylene diamine. This category contains a full range of non-ionic surfactants the properties of which depend on the hydrophobic/hydrophilic moieties ratio in the molecules.

5. The products of condensation of alkylene-oxides, e.g. ethylene-oxide with fatty amides, e.g. ethanolamides or diethanolamides of fatty acids. Such polyethylene-oxyamides of fatty acids with 8 to 20 C atoms are the preferred nonionic surfactants in the invention. The fatty acids are, as above, derived from palm, tallow and coconut (copra) oils. The preferred products are the amides derived from fatty acids of tallow and copra condensed with 4 to 20 O.E. units. Such polyalkyleneoxyamides are commercially available and should not be confused with the conventional fatty acid amides used in laundry compositions, such as these disclosed in British Pat. No. 638.637 which have markedly different properties.

The anionic surfactants used in the present composition are α-sulfonates of fatty acid derivatives such as the esters and amides sulfonates of formulae I and II below

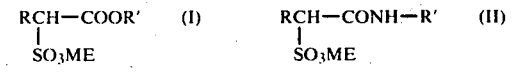

wherein R is a linear alkyl radical with 6–20 C atoms, R' is a lower alkyl, e.g. methyl, ethyl, propyl, butyl, hexyl and isomers thereof and ME is an alkali metal or a quaternary ion of ammonium, mono- or diethanolamine. These α-sulfonates are derived from fatty acids or mixtures thereof. The preferred acids are stearic and palmitic acids. The preferred fatty acids mixtures are those from hydrogenated tallow and palm-oils. The anionic surfactants used in the present composition may also be α-sulfonates of fatty acid derivatives of the formula:

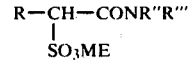

wherein R is a straight $C_6$ to $C_{20}$ alkyl radical, R'' and R''', which may be identical or different, are H or a $CH_2$—$CH_2OH$ group and ME is an alkali metal ion or an ammonium, monoethanolamine or diethanolamine cation.

The preparation of the α-sulfonates of fatty acids and esters can be effected according to usual means disclosed in the technical literature. For instance, one can sulfonate linear esters of the $C_8$ to $C_{22}$ acids and lower alcohols with gaseous $SO_3$ according to "The Journal of the American Oil Chemists Society" 52 (1975), p. 323–329. One can also use solutions of $SO_3$ in dioxane or chloro-sulfonic acid (see A. J. STIRTON, α-sulfo-fatty acids and Derivatives, the Journal of the American Oil Chemists Society 39 (1962), p. 490–496).

Regarding the α-sulfonated amides, one can, for example sulfonate fatty acids by the same methods used for the esters (see for instance, Journal of the American Oil Chemists Society 37 (1960), p. 679) and convert such α-sulfonated acids into the corresponding amides via acid chlorides and the reaction thereof with amines, e.g. ethanolamine (see, Journal of the American Oil Chemists Society 37 (1960), p. 295). One can also obtain such sulfonated derivatives by using, as starting materials, natural fatty substances such as derived from tallow, palm-oil, etc.

The compositions of the invention can further contain at least one alkaline additive of detergency which has a "builder" function, e.g. Na silicate with a mole ratio $SiO_2/Na_2O$ of preferably about 1.6. Other builders such as $Na_2CO_3$, sodium citrate, sodium silico-aluminate and sodium nitrilotriacetate (NTA) can also be used. Sodium tripolyphosphate is unnecessary and is excluded from the present invention because of its polluting effect on effluent waters. The amount of silicate in weight % of the composition can reach 15% but is, preferably, only 7.5%.

Depending on end-uses, the present compositions may also contain some quantities of other ingredients. Thus, when the compositions are specially intended for laundering white fabrics, they may contain bleaching agents such as alkali perborate the quantity of which may be 23% by weight and preferably 20%.

In the absence of perborate, the amount of soap will preferably be around 80%, for instance if the compositions are designed for laundering dyed or synthetic fabrics.

Other addition agents can also be used in the composition of the invention, e.g. optical brighteners, light fragrances, enzymes and anti-redeposition agents like carboxy-methylcellulose. The preferred brighteners are derivatives of imidazolone, dibenzimidazole and benzoxazole. As perfumes, one can use mixtures of the following odoriferous products, synthetic bergamot, hydroxycitronellol, methyl dihydrojasmonate, phenylethyl alcohol, synthetic jasmine-oil, vetiveryl acetate, etc. The proportions of such additives do not exceed 3% by weight of the compositions, and preferably 1.5 to 1.9%. However, all concentrations given herein are only indicative and should not be considered as limitative.

Nonionic tensids used in the present invention are good or excellent dispersants of hard soaps, even at low concentrations (a few % of the weight of soap). There exists several methods to measure the dispersing powers of detergents, e.g. a spectrometric cloudiness method (BORSTLA), the method of BORGHETTI-BERGMANN (Journal of the American Oil Chemists Society 27 (1950), the method of HARBIG and the method of SCHOENFELT (Chem. Phys. Appl. Surface Active Subst. Prac. Int. Congr. 4th, 3 (1964). This last method, slightly modified, was used herein to evaluate the dispersing power of the surfactants used in the invention. The measurements have been carried out using 1 g/l solutions of sodium oleate or soap in a water of hardness 27° (French), that is with an equivalent of 270 ppm $CaCO_3$, with variable concentration of the surfactants. Table I shows, successively, the surfactant kind, its chemical structure and the number of O.E. (ethylene oxide units) condensed therewith, the percents of surfactant relative to the total of soap and the percent dispersion.

TABLE 1

DISPERSING POWER OF NONIONIC DETERGENTS

| Surfactant | Chemical structure & number of O.E.* units | % surfactant based on Na oleate | Results % dispersion | % surfactant based on soap | Results % dispersion |
|---|---|---|---|---|---|
| Polyethylene-oxy-alcohols | Fatty alcohol $C_{18}$ 11 O.E. | 2.5 | 96 | 2.5 | 100 |
| | Fatty alcohol $C_{14}$ 12 O.E. | 2.5 | 98 | 3 | 98.5 |
| | Fatty alcohol $C_{18}$ 25 O.E. | 2.8 | 98 | 3 | 100 |
| | Fatty alcohol $C_{18}$ 50 O.E. | 2.8 | 98.5 | 3 | 97 |
| | Fatty alcohol $C_6$—$C_{18}$ 25 O.E. | 3 | 100 | 3.5 | 100 |
| | Fatty alcohol $C_{16}$—$C_{20}$ 50 O.E. | 3 | 97 | 4 | 100 |
| Polyethylene-oxy-alkyl-phenols | Nonylphenol 9 O.E. | 3 | 97 | 4 | 100 |
| | Nonylphenol 11 O.E. | 3 | 100 | 3.5 | 100 |
| | Nonylphenol 14 O.E. | 3 | 99 | 3 | 98.5 |
| | Nonylphenol 25 O.E. | 2.5 | 100 | 2.5 | 97 |
| | Nonylphenol 50 O.E. | 2.5 | 98 | 4 | 95.5 |
| | Octylphenol 40 O.E. | 3.2 | 98.5 | 4 | 100 |
| Polyethylene-oxy-fatty amides | Monoethanolamide of copra 10 O.E. | 2.5 | 98.5 | 3 | 99 |
| | Diethanolamide of copra 12 O.E. | 2.8 | 99 | 3.2 | 98.5 |
| Polyethylene-oxy-polypropy-lene glycol | 80% O.P.** 20% O.E. | 3 | 100 | 4.5 | 100 |

*O.E. = oxyde of ethylene units
**O.P. = oxyde of propylene units

It is seen from the above results that most of the surfactants tried are good dispersing agents of lime soaps. It is interesting to note that, everything else being equivalent, the dispersing powers are slightly better for sodium oleate than for sodium soap. The best results are obtained with polyethyleneoxy-fatty alcohols, -fatty amides and -nonylphenol. The overall length of the polyethyleneoxy chain does not seem to affect the dispersing power nor does the size of the alkyl side groups of the compounds. The above results also show that satisfactory dispersing action results from using about 2.5–4% (relative to soap) of the above detergents, such concentration being sufficient for good dispersivity in waters as hard as 27° (French).

The anionic surfactants used in the invention, particularly the α-sulfonates of the methyl and ethyl esters of fatty acids were tested for their dispersing activity under the same conditions as for the non-ionic compounds. The results are found in Table 2.

TABLE 2

| ESTERS | % ester based on soap | % dispersion |
|---|---|---|
| Methyl ester of the α-sodio-sulfonated palmitic acid | 10% | 70% |
| | 20% | 94% |
| | 25% | 94.5% |
| Ethyl ester of the α-sodio-sulfonated palmitic acid | 10% | 68.25% |
| | 20% | 92.5% |
| | 25% | 97% |
| Methyl ester of the α-sodio-sulfonated stearic acid | 10% | 50.5% |
| | 20% | 95.5% |
| | 25% | 98% |
| Ethyl ester of the α-sodio-sulfonated stearic acid | 10% | 47.5% |
| | 20% | 82.5% |
| | 25% | 95.5% |

The anionic surfactants are therefore much less active, as hard-soap dispersants, than the nonionic surfactants discussed hereintofore. Thus, for sufficient activity as such they should be used in much higher concentrations (about 25% instead of 3%). Therefore the present compositions will rely mainly on the non-ionic detergents for achieving dispersions of the lime-soaps.

The presence of the α-sulfonated esters is however very important in the soap based laundry compositions of the invention as they impart thereto an excellent detergent washing capacity as will be seen hereinafter from the results of Table 3. It is interesting to note at this stage that, in general, for a given compound, the hard-soap dispersing power does not parallel the detergent capacity. Thus, against all expectations, non-ionic polyethyleneoxy compounds do not impart to the washing powders a high detergent capacity for soiled fabrics unless quantities (about 7.5%) higher than those necessary for dispersing hard-soaps (3%) are used. This will also become clear with regard to the results of Table 3 hereinafter.

Generally speaking the detergent capacity of washing materials are expressed as reflectivity measurements (in % relative to an arbitrary 100% value given to pure MgO) carried out on washed standard cotton fabric samples previously stained with standard soiling agents according to the EMPA Standards (Eidgenössische Materialprüfung Anstalt of Switzerland). The EMPA standards No 101 or 103 comprise the following cotton samples.

Bleached cotton, no optical brightener
Cotton with EMPA standard soils
Cotton soiled with blood
Cotton soiled with Cocoa
Cotton soiled with blood/milk/china ink
Cotton dyed with black of sulfur
Raw Cotton
Cotton soiled with red wine After washing the reflectivity measurements are made with an ELREPHO-ZEISS colorimeter (λ 460 nm, reference MgO = 100% reflectivity).

The washing itself in an automatic laundry machine is standardized as follows:

Prewash 60° C.; wash 95° C. (boil); charge 2 kg of dry clothes with natural dirt mixed with the samples; charge ratio (weight of samples/weight of charge), 1/14; bath ratio (weight of charge/weight of water), 1/6; detergent concentration, 5 g/l; water hardness adjusted to 25° (French); time of washing, 80 min.

For evaluating the foam formation, the Ross-Miles method was used according to known standards STMD-1073-53 (1973), see for instance L. CHALMERS, "Domestic & Industrial Chemical Specialties", Leonard Hill, London (1966). This foam evaluation was visual and qualitative.

The various tests described above were effected on soap-based compositions containing:

1. A polyethyleneoxy-fatty alcohol (without anionic surfactant)

2. A mixture of α-sulfonated fatty acids methyl esters (without nonionic surfactants)

3. and 4. Mixtures of anionic and non-ionic surfactants in variable proportions. The compositions are given in % by weight. Results are shown in Table 3.

TABLE 3

| Test No. | | 1 | 2 | 3 | 4 |
|---|---|---|---|---|---|
| Ingredients % by weight | | | | | |
| Soap | | 60 | 60 | 60 | 60 |
| Fatty alcohol ($C_{16}$—$C_{20}$) polyoxyethylenated (50 O.E.) | | 7.5 | — | 3.75 | 0.5 |
| Methyl esters of α-sulfonated fatty acids mixture with 50% palmitic acid and 50% stearic acid | | — | 7.5 | 3.75 | 8.5 |
| Silicate of sodium | | 7.5 | 7.5 | 7.5 | 8 |
| Perborate of sodium | | 23.1 | 23.1 | 23.1 | 17.1 |
| Additives: | | | | | |
| carboxymethylcellulose: | 1 | 1 | 1 | 1 | 1 |
| EDTA: | 0.5 | 0.5 | 0.5 | 0.5 | 0.5 |
| Optical brightener: | 0.2 | 0.2 | 0.2 | 0.2 | 0.2 |
| Perfume: | 0.1 | 0.1 | 0.1 | 0.1 | 0.1 |
| Paraffin oil: | 0.1 | 0.1 | 0.1 | 0.1 | 0.1 |
| Total of ingredients | | 100 | 100 | 100 | 100 |
| Results | | | | | |
| Detergent power**, reflectivity on sample with standard soiling EMPA No 101 (% reflectivity) | | 57.6 | 59.2 | 54.8 | 53.9 |
| Amount of foam | | good | poor | good | poor |

**in comparison, the average detergent power of a synthetic washing powder was 56.75.

The results of Table 3 show that

1. The first composition with no anionic surfactant procures a rather satisfactory foam control but it contains a rather high ratio of non-biodegradable nonionic surfactant which is borderline for low polluting washing compositions. If this ratio is decreased, the detergent capacity also decreases.

2. The second composition without nonionic surfactant has a good detergent activity and contains a fully degradable anionic surfactant. However, it produces too much foam and is useless in soft waters.

3. The third composition which comprises equivalent quantities of nonionic and anionic surfactants does not belong either to the invention and, contrary to expectations, has a poor detergent capacity.

4. The fourth composition also has anionic and nonionic surfactants in concentrations outside the value permissible in the invention. It produces much foam and does not wash well.

In contrast, as will be seen in the following Examples, the compositions according to the invention do not have the above drawbacks because of properly selected ingredients and concentrations. They have a good detergent ability while maintaining the volume of froth under control.

The formulae of the compositions according to the invention are intended for being used in the preparation of detergents in powder or flake form by atomization according to known techniques. Thus, the ingredient of the composition are dissolved or suspended in water at 75°-80° C. and the resulting slurry is sprayed in a current of warm air inside of a drying tower. Therefore, the final product is in the form of a dry powder collected at the bottom of the tower and is easily soluble in water.

The following Examples illustrate the invention in a more detailed manner.

EXAMPLE 1

A laundry composition was prepared by mixing the following ingredients in the given % by weight and atomizing in a drying tower.

| Ingredients | % by weight |
|---|---|
| Tallow soap | 60 |
| Copra monoethanolamide . 10 O.E. | 2.5 |
| α-sodio-sulfonate of methyl stearate and palmitate (ratio 1/1) | 7.5 |
| $Na_2SiO_3$ | 7.5 |
| $NaH_2BO_4$ | 21 |
| Carboxymethyl-cellulose (CMC) | 1 |
| EDTA (ethylene-diamine tetraacetic acid) | 0.5 |
| Optical brightener | 0.2 |
| Fragrance | 0.2 |
| Total | 100. |

This composition was tested by EMPA standards as explained above and gave the following results: EMPA sample No. 101 with standard soils, prewash 60° C., wash 95° C., reflectivity 59.1%. Foam control satisfactory at 40°, 60°, 95° C. and in waters of hardness 0° to 25° (French). Wear extent after 25 washings (60°/95° C.), 8.4% loss of tensile strength; under identical conditions a commercial synthetic detergent produced a 10.2% loss in strength. Ashes and organic deposits after 25 washings, very small. Solubility at various temperatures, good.

EXAMPLE 2

As in Example 1, a detergent composition was prepared as follows:

| Ingredients | % by weight |
|---|---|
| Tallow soap | 60 |
| Copra monoethanolamide with 10 O.E. | 2.1 |
| 1/1 mixture of α-sodio-sulfonated stearic and palmic acids | 7.5 |
| Sodium silicate | 7.5 |
| Sodium perborate | 20.73 |
| Enzyme (alcalase) | 0.27 |
| Carboxymethylcellulose (CMC) | 1 |
| EDTA | 0.5 |
| Brightener | 0.2 |
| Perfume | 0.2 |
| Total | 100 |

This composition was evaluated in 5 g/l washes using EMPA No. 103 standard samples and compared to a well known commercial synthetic detergent containing also perborate and enzymes. The reflectivity results of Table 4 have been averaged from four washing tests each. Temperatures, prewash 60°, wash 95° C. Water hardness, 25° (French).

TABLE 4

| Composition | Reflectivity (%) Composotion of Example 2 | Commercial synthetic detergent |
|---|---|---|
| Bleached cotton | 100 | 100 |
| Pigment soil: | | |
| EMPA standard soil | 59.5 | 60.37 |
| Albuminous soils: | | |
| Blood | 93.12 | 93.25 |
| Cocoa | 63.37 | 63 |
| Blood/milk/china ink | 40.37 | 46.12 |
| Bleachable soils: | | |
| Instant black | 55.25 | 53 |
| Raw cotton | 81 | 79.62 |
| Red wine | 97 | 95.25 |
| Total of all soils | 589.61 | 590.61 |
| Total of all albuminous soils | 196.86 | 202.37 |
| Total of all bleachable soils | 233.25 | 227.87 |

The results of Table 4 show that, besides its biodegradability capacity, the present composition washes at least as well as a synthetic conventional laundry composition.

EXAMPLE 3

A powdered composition (A) for laundering in conformity with the invention, was prepared by atomization from the following ingredients (% by weight):

| Ingredients | |
|---|---|
| Soap | 78.5% |
| Ethanolamide of copra condensed with 10 O.E. (oxide of ethylene units) | 2.5% |
| 50/50 mixture of the α-sodio-sulfonates of methyl palmitate and stearate | 7.0% |
| Sodium silicate | 9.5% |
| Carboxymethylcellulose | 1% |
| Enzyme (alcalase) | 0.5% |
| Optical brightener (benzoxazole) | 0.2% |
| Sequestrant (Sequestrene) | 0.5% |
| Perfume | 0.3% |

In order to differentiate the properties of the composition (A) from the properties of compositions derived from the teaching of the prior art, namely U.S. Pat. No. 3,794,589 which discloses the use, as anionic surfactants, of organic sulfates and sulfonates, and Great Britian Pat. No. 638,337 which discloses, as nonionic surfactants, fatty acid amides with no polyoxyethylene side groups, control compositions (B), (C) and (D) were prepared as follows:

For (B) and (C), the mixture of α-sulfonated esters of (A) was replaced by an identical amount (7%) of lauryl-sodio-sulfate (B) and, respectively, sodium dodecylbenzene sulfonate (C). Except for these differences (B) and (C) were identical to (A).

For (D), the (A) composition was again taken except for the replacement of the amide condensed with 10 O.E. by copra diethanolamide not carrying any polyoxyalkylene side chain.

These four compositions were compared to each other with reference to the reflectivity percent of EMPA standards after washing at the usual 3 washing temperatures 40°/45° C.; 60° C. and 95° C. The results are shown in Table 5.

TABLE 5

| Samples | Reflectivity after washing at the three temperatures | | | |
|---|---|---|---|---|
| | Comp. (A) | Comp. (B) | Comp. (C) | Comp. (D) |
| Bleached cotton | 96.75; 94.7; ≧100 | 94.1; 94.3; ≧100 | 93.9; 94.2; 100 | 94.3; 94.4; ≧100 |
| EMPA standard soil | 57.8; 59; 64.9 | 57.1; 58.3; 63 | 56.1; 57.5; 64.2 | 55.2; 55.9; 63.5 |
| Albuminous soils: | | | | |
| blood | 92.4; 91.6; 98.8 | 91; 90.8; 98.1 | 90.3; 91.2; 98.4 | 90; 91.2; 97.5 |
| Cocoa | 50.6; 51.1; 54.5 | 50.8; 50.6; 51.6 | 49.8; 47.7; 53 | 49; 47.7; 52.3 |
| Blood/milk/ink | 68.6; 71.6; 77 | 70.2; 71.5; 77 | 69.6; 71; 75.6 | 69, 69.6; 75.6 |
| Bleachable soils: | | | | |
| Instant black | 48.3; 49.8; 56.1 | 49; 49.4; 55.1 | 47.7; 49.6; 55.2 | 47.5; 48.4; 54.8 |
| Raw cotton | 69.7; 69.4; 73.1 | 69.5; 69.5; 72.9 | 69.5; 69.8; 72.6 | 68.8; 69.4; 72.1 |
| Red wine | 63.5; 63.4; 68.6 | 64.8; 61.8; 64.8 | 60.3; 63.1; 66.5 | 60.5; 62.5; 64.5 |
| Total of all soils | 547.5; 550.5; 592.9 | 546.4; 545.8; 582.4 | 537; 543.8; 585.4 | 534.1; 538.9; 580 |
| Total alb. soils | 211.6; 214.3;230.4 | 211.9; 212.8; 226.7 | 209.7; 209.8; 229.9 | 208; 208.4; 225.3 |
| Total bl. soils | 181.4; 182.5;197.9 | 183.4; 180.6; 192.8 | 177.4; 182.4; 194.3 | 176.8; 180.2; 191.3 |

It is seen from the results of Table 5 that composition (A) has practically in all cases, equal washing ability as (B), (C) and (D) derived from the teaching of the prior-art.

It was further noticed that composition (B) containing lauryl sulfate gave too much foam and did not well disperse the lime-soaps. Further, the use of a simple fatty diethanolamide (D) instead of an amide condensed with polyoxyethylene units gave also inferior results regarding foam and detergency.

It should be remarked that the combination of α-sulfonated fatty esters and a polyoxyethylenated amide gives to the present compositions their particularly advantageous properties for automatic laundering. Indeed, in contrast with the alkyl- and aryl-sulfonates of the prior-art, the α-sulfonated esters impart to the washing compositions a detergent power independent of the water hardness, excellent detergent properties even at low concentration, good washing qualities for cotton and cotton-polyesters mixed fabrics in the complete absence of polyphosphates, a good dispersing power and a perfect skin innocuity.

One can also notice the anti-foam property of the polyoxy ethylated amides and their advantages over the non-polyoxyalkylated amides because of their more favorable hydro-lipophilic balance, the relatively long hydrophilic moiety of these compounds being constituted by the polyoxyalkylated chain.

The silicate used in the present compositions is particularly advantageous for its wetting, emulsifying, deflocculating, anti-redepositing, softening and antioxidant properties which oppose the growing rancid of the soaps.

It should also be remarked that in compositions such as (A), perborates are no more necessary and can be suppressed.

EXAMPLE 4

The composition (A) of Example 3 was compared to two well known commercial washing compositions labelled LC1 and LC2. The results of the washing tests provided as the reflectivity values measured on EMPA samples are summarized in Table 6. These results show that the detergency of the composition according to the invention is slightly less than the detergency of the commercial compositions with regard to the bleaching soils; however, this is compensated by the better washing of albuminous stains and by the bio-degradability properties which are the essentials of the invention.

TABLE 6

| | Reflectivity after washing at the three temperatures | | | | | | | | |
|---|---|---|---|---|---|---|---|---|---|
| | Comp. (A); Example 3 | | | $LC_1$ | | | $LC_2$ | | |
| Washing temperature (°C.) | 40/45° | 60° | 95° | 40/45° | 60° | 95° | 40/45° | 60° | 95° |
| Samples (EMPA) | | | | | | | | | |
| Bleached cotton | 96.75 | 94.70 | ≧100 | 98.5 | ≧100 | ≧100 | ≧100 | 99.85 | ≧100 |
| Pigment soil: | | | | | | | | | |
| EMPA standard soil | 57.80 | 58.95 | 64.90 | 51.97 | 57.90 | 63.15 | 52.45 | 55.80 | 61.80 |
| Albuminous soils: | | | | | | | | | |
| Blood | 92.40 | 91.65 | 98.80 | 88.2 | 90.05 | 95.96 | 88.05 | 87.55 | 93.25 |
| Cocoa | 50.55 | 51.10 | 54.60 | 53.10 | 56.90 | 64.15 | 53.10 | 57.95 | 61.45 |
| Blood/milk/china ink | 68.60 | 71.55 | 76.95 | 53.15 | 52.30 | 54.75 | 44.95 | 45.45 | 48.40 |
| Bleachable soils: | | | | | | | | | |
| Instant black | 48.25 | 49.75 | 56.10 | 47.20 | 49.85 | 56.30 | 46.40 | 48.80 | 56 |
| Raw cotton | 69.65 | 69.40 | 73.05 | 68.40 | 72.65 | 78.30 | 70.10 | 71.60 | 77.90 |
| Red wine | 63.50 | 63.35 | 68.55 | 67.55 | 73.70 | 95.55 | 69.20 | 79.35 | 95.40 |
| Total of all soils | 547.45 | 550.45 | 592.90 | 528.75 | 553.30 | 608.10 | 524.15 | 546.20 | 594.15 |
| Total of all albuminous soils | 211.55 | 214.30 | 230.35 | 195.2 | 199.30 | 214.85 | 186.05 | 190.90 | 203.10 |
| Total of all bleachable soils | 181.40 | 182.5 | 197.90 | 183.15 | 196.20 | 230.15 | 185.70 | 199.75 | 229.30 |

EXAMPLE 5

A series of detergent compositions similar to that of Example 1 were prepared by using various other fatty amides, namely, lauryl-monoethanolamide. 15 O.E.; hydrogenated tallow-monoethanolamide condensed with 10 O.E. and coconut fatty acid-ethanolamide with 12 oxide of ethylene units. All these compositions gave excellent results, namely for the high temperature washing of cotton.

EXAMPLE 6

A detergent composition was prepared from the following compounds:

| | |
|---|---|
| Tallow soap | 60% |
| Polyoxyethylenated $C_{16}$-$C_{20}$ fatty alcohol with 50 O.E. | 3% |
| Sodium silicate | 7% |
| Sodium perborate | 21.1% |
| CMC | 1% |
| EDTA | 0.5% |
| Brightener | 0.2% |
| Perfume | 0.2% |
| Total | 100% |

The reflectivity after washing of EMPA No. 101 standards was very good (58%). The washing operation was fully steady and the foam volume was well controlled at 40°, 60° and 90° C. with waters of different hardness.

EXAMPLE 7

Composition similar to that of Example 1 were prepared by replacing the α-sulfonated methyl stearates of palmitic and stearic acids by other anionic surfactants, namely, sodiosulfonates of the corresponding ethyl esters, the α-sulfonates of the tallow derived hydrogenated fatty acid esters and the corresponding α-sulfonates of hydrogenated palm fatty esters. All these compositions gave excellent washing results.

EXAMPLE 8

In all compositions of Examples 1, 2 and 5 to 7, part of the tallow soap (16.8%) was replaced by copra soap. No significant property change was observed. Similarly, when 20% of the Na soaps were replaced by their equivalent K soaps, no behavior change was noticed.

EXAMPLE 9

A detergent composition was prepared as follows:

| | |
|---|---|
| Copra soap | 60% |
| Copra monoethanolamide . 10 O.E. | 2.1% |
| α-sulfonated diethanolamide of palmitic acid | 7.5% |
| Sodium silicate | 7.5% |
| Sodium perborate | 21% |
| CML | 1% |
| EDTA | 0.5% |
| Brightener | 0.2% |
| Perfume | 0.2% |
| Total | 100% |

This composition gave results similar to that of Example 2.

EXAMPLE 10

A detergent composition was prepared according to the following formulation:

| | |
|---|---|
| Tallow soap | 60% |
| Polyoxyethylated $C_6$-$C_{18}$ fatty alcohol (25 O.E.) | 3% |
| α-sulfonated-stearyl-monoethanolamide | 6.6% |
| Sodium silicate | 7.5% |
| Sodium perborate | 21% |
| CML | 1% |
| EDTA | 0.5% |
| Brightener | 0.2% |
| Perfume | 0.2% |
| Total | 100% |

This composition gave good results but the volume of foam was more abundent.

We claim:

1. A detergent composition mainly for automatic laundering machines which consists essentially of, based on the weight of the total composition, at least 60% of at least one alkali or ammonium salt of a fatty acid and no more than 10% of a mixture of surfactants containing 10 to 30% of at least one non-ionic water-soluble polyoxyalkylated surfactant selected from the group consisting of a polyoxyalkylated derivative of $C_8$-$C_{20}$ alcohols, a polyoxyalkylated derivative of alkyl or di-alkyl phenols, a polyxylalkylated derivative of a polyoxypropylated propylene glycol, a polyoxyalkylated derivative of a polyoxypropylated diamine and a polyoxylalkylated derivative of a fatty amide and 90 to 70% of at least one water-soluble anionic surfactant, selected from the group consisting of an α-sulfonated fatty acid ester of the formula $$\begin{array}{l} RCH{-}COOR' \\ \quad\;\; | \\ \quad SO_3ME \end{array}$$

wherein R is a linear alkyl radical with 6–20 C atoms, R' is an alkyl radical selected from the group consisting of methyl, ethyl, propyl, butyl, hexyl and isomers thereof and ME is an alkali metal or a quaternary ion of ammonium, mono- or diethanolamine and an α-sulfonated fatty acid amide of the formula $$\begin{array}{l} RCH{-}CONH{-}R' \\ \quad\;\; | \\ \quad SO_3ME \end{array}$$

wherein R is a linear alkyl radical with 6–20 C atoms, R' is an alkyl radical selected from the group consisting of methyl, ethyl, propyl, butyl, hexyl and isomers thereof and ME is an alkali metal or a quaternary ion of ammonium, mono- or diethanolamine.

2. The composition of claim 1, wherein the α-sulfonated fatty acid ester is an α-sulfonated methyl ester of a hydrogenated tallow fatty acid.

3. The composition of claim 1, wherein the α-sulfonated fatty acid ester is an α-sulfonated methyl ester of a fatty acid derived from hydrogenated palm-oil.

4. The composition of claim 1, wherein the α-sulfonated fatty acid amide has the formula $$\begin{array}{l} R{-}CH{-}CONR''R''' \\ \quad\;\; | \\ \quad SO_3ME \end{array}$$

wherein R is a straight $C_6$ to $C_{20}$ alkyl radical, R'' and R''', which may be identical or different, are H or a $CH_2$—$CH_2OH$ group and ME is an alkali metal ion or an ammonium, monoethanolamine or diethanolamine cation.

5. The composition of claim 1 wherein the mixture of surfactants comprises by weight of the total composition 2–3% of nonionic surfactant and 6 to 8% of anionic surfactant.

6. The composition of claim 5 wherein said anionic surfactant comprises 7.5% by weight of the total composition.

7. The composition of claim 1, wherein the nonionic surfactant is a polyoxyalkylated fatty amide.

8. The composition of claim 7, wherein said amide is a copra-derived polyoxyethylated monoethanolamide with 10 molecules of ethylene oxide (10 O.E.).

9. The composition of claim 1, wherein the nonionic surfactant is a polyoxyethylated fatty alcohol.

10. The composition of claim 9, wherein the polyoxyethylenated fatty alcohol is a $C_{16}$–$C_{20}$ fatty alcohols mixture condensed with 50 moles of ethylene oxide (50 O.E.).

11. The composition of any one of claims 1-3,5 and 1-9 7-10 which contains 80–85% of soap, 8–10% of the mixture of surfactants and further includes, 6–8% of alkali silicates.

12. The composition of any one of claims 1-3,5 and 7-10, which further includes, by weight 8–10% of alkali silicate, and 18–23% of sodium perborate.

* * * * *

UNITED STATES PATENT AND TRADEMARK OFFICE

CERTIFICATE OF CORRECTION

PATENT NO. : 4,194,986

DATED : March 25, 1980

INVENTOR(S) : Herve Tournier and Alain Groult

It is certified that error appears in the above-identified patent and that said Letters Patent are hereby corrected as shown below:

Column 16, line 4, delete "1-9".

Signed and Sealed this

*Tenth* Day of *June 1980*

[SEAL]

*Attest:*

SIDNEY A. DIAMOND

*Attesting Officer*

*Commissioner of Patents and Trademarks*